US006735321B2

(12) United States Patent
Mazejka et al.

(10) Patent No.: US 6,735,321 B2
(45) Date of Patent: May 11, 2004

(54) LOUDSPEAKER ENCLOSURE MOUNTING ABOVE LISTENER

(75) Inventors: John W. Mazejka, Charlton, MA (US); Peter C. Santoro, Shirley, MA (US)

(73) Assignee: Bose Corporation, Framingham, MA (US)

( * ) Notice: Subject to any disclaimer, the term of this patent is extended or adjusted under 35 U.S.C. 154(b) by 162 days.

(21) Appl. No.: 10/116,268

(22) Filed: Apr. 4, 2002

(65) Prior Publication Data

US 2003/0190048 A1 Oct. 9, 2003

(51) Int. Cl.[7] ..... H04R 25/00

(52) U.S. Cl. ..... 381/395; 381/386; 248/343; 362/365

(58) Field of Search ..... 248/343; 362/365; 381/333, 334, 336, 345, 386, 387, 388, 389, 395, 189

(56) References Cited

U.S. PATENT DOCUMENTS

| | | | | | |
|---|---|---|---|---|---|
| 3,812,301 | A | * | 5/1974 | Lahti | 381/341 |
| 3,912,865 | A | * | 10/1975 | Seebinger | 381/124 |
| 5,574,796 | A | * | 11/1996 | Keezer | 381/386 |
| 5,931,432 | A | * | 8/1999 | Herold et al. | 248/343 |
| 5,937,073 | A | * | 8/1999 | Van Gieson | 381/391 |
| 5,941,625 | A | * | 8/1999 | Morand | 362/148 |
| 6,578,808 | B1 | * | 6/2003 | Bertagni et al. | 248/343 |
| D477,308 | S | * | 7/2003 | Mazejka et al. | D14/216 |

* cited by examiner

*Primary Examiner*—Suhan Ni
(74) *Attorney, Agent, or Firm*—Fish & Richardson P.C.

(57) ABSTRACT

A loudspeaker enclosure is formed with fins that may be extended to support the enclosure on a surface and retracted into mating recesses to comprise a cosmetically appealing outer surface when the enclosure is suspended.

5 Claims, 5 Drawing Sheets

LOUDSPEAKER ENCLOSURE MOUNTING ABOVE LISTENER

BACKGROUND OF THE INVENTION

The present invention relates in general to loudspeaker enclosure mounting above listener, and more particularly concerns novel apparatus and techniques that allow the loudspeaker enclosure for use above the listener's location to be mounted in a surface, such as the ceiling, or be flown from suspended cables while allowing the flown enclosure to have a pleasing cosmetic appearance.

Loudspeaker enclosures for use above the listener's location are typically mounted in a surface, such as the ceiling, or flown from suspending cables. A typical prior art approach for maintaining a pleasing cosmetic appearance for a flown enclosure is to use an extra cosmetic casing to present a pleasing cosmetic appearance.

SUMMARY OF THE INVENTION

It is an important object of the invention to provide a loudspeaker enclosure for use above the listener's location that can be readily mounted in a surface, such as the ceiling, and flown from suspending cables with a cosmetically pleasing appearance.

According to the invention, a loudspeaker enclosure includes foldable extendable fins that are extended when mounting in a surface, such as the ceiling, and retracted into mating recesses flush with the sides of the enclosure when flown from suspending cables.

Other features, objects and advantages of the invention will become apparent from the following detailed description when read in connection with the accompanying drawing in which:

DETAILED DESCRIPTION

Figure 1:
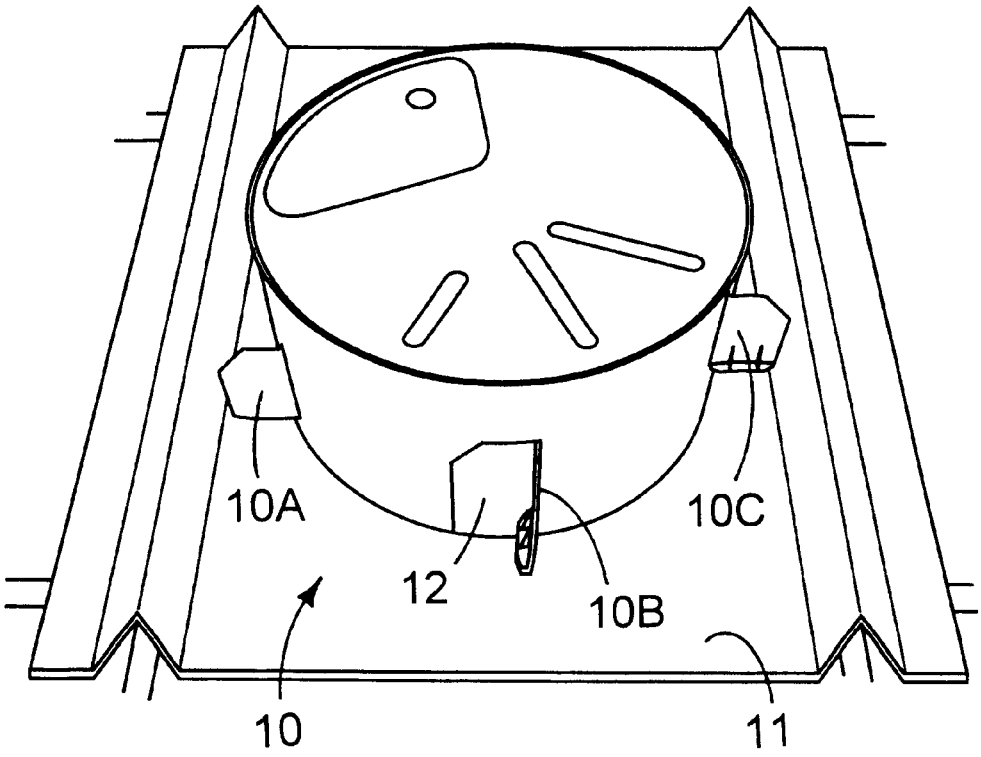
FIG. 1 is a pictorial view of an embodiment of the invention mounted in a ceiling panel with fins exposed.

With reference now to the drawing and more particularly FIG. 1 thereof, there is shown a pictorial view of a loudspeaker enclosure 10 mounted in a ceiling panel 11. Loudspeaker enclosure 10 has four hinged fins, three of which 10A, 10B and 10C, are visible in FIG. 1. When retracted, the fins seat in mating recesses, such as 12. Then, exposed surfaces of the fins are coextensive with the outer surface of the rest of the loudspeaker enclosure so that when flown, such as shown in FIG. 2, the enclosure presents a cosmetically pleasing surface.

Figure 2:
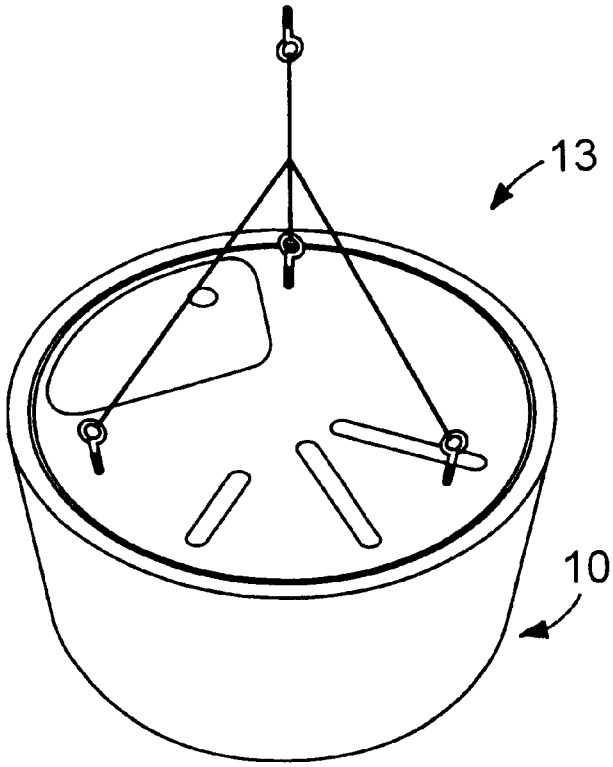
FIG. 2 is pictorial view of the enclosure of FIG. 1 flown from suspending cables with fins retracted to present a pleasing cosmetic appearance.

Referring to FIG. 2, there is shown a pictorial view of loudspeaker enclosure 10 with fins 10A, 10B and 10C retracted into the mating recesses, such as 12, so that the flown or suspended enclosure has a continuous cosmetically pleasing surface when suspended from a ceiling with suspension assembly 13.

Figure 3A:
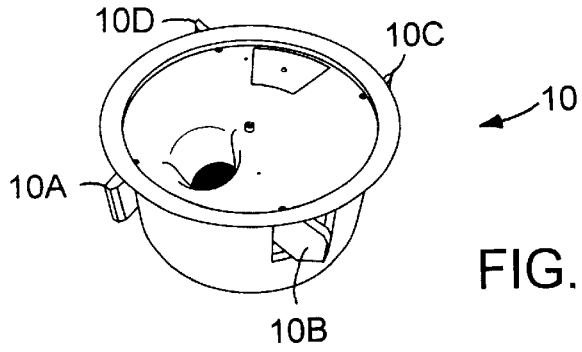
FIGS. 3A–3H are illustrations helpful in understanding ceiling mounting.
Figure 3B:
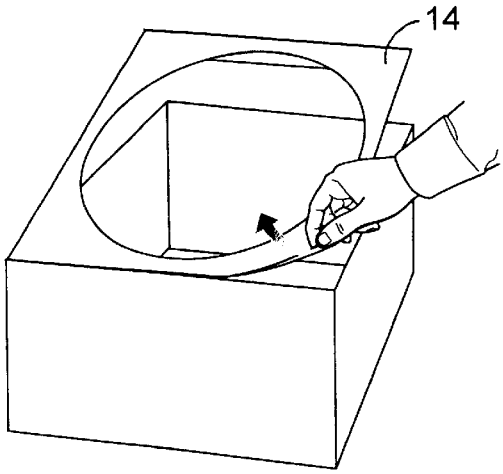
Figure 3C:
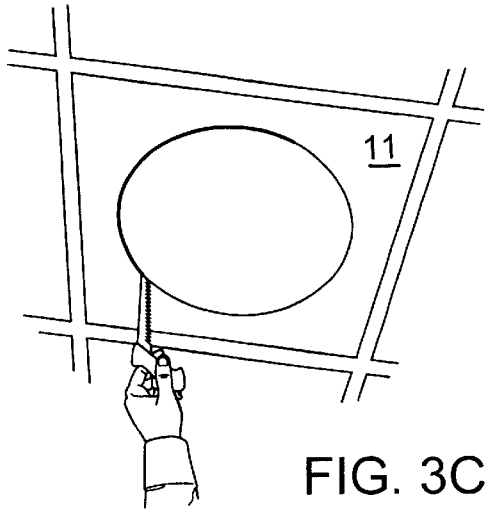
Figure 3D:
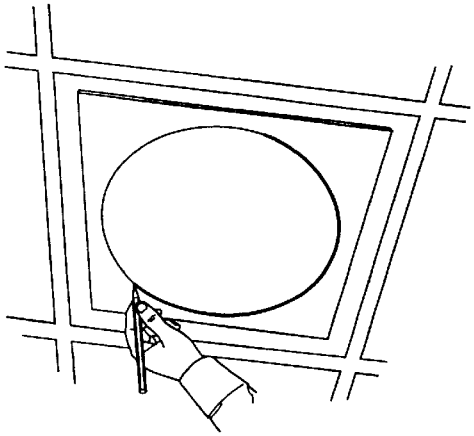
Figure 3E:
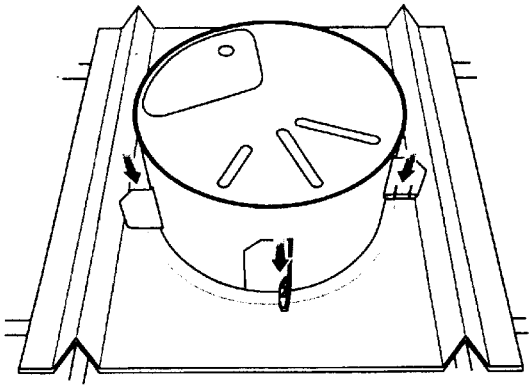
Figure 3F:
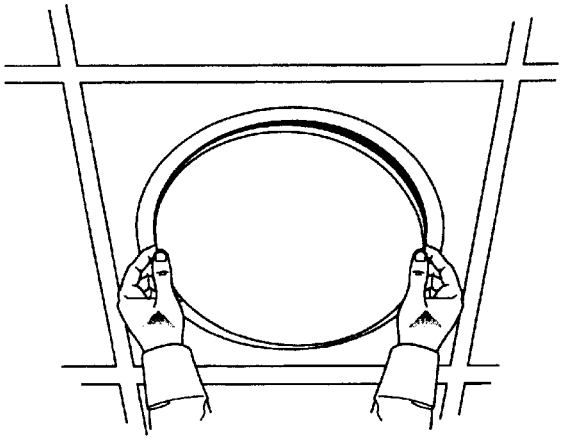
Figure 3G:
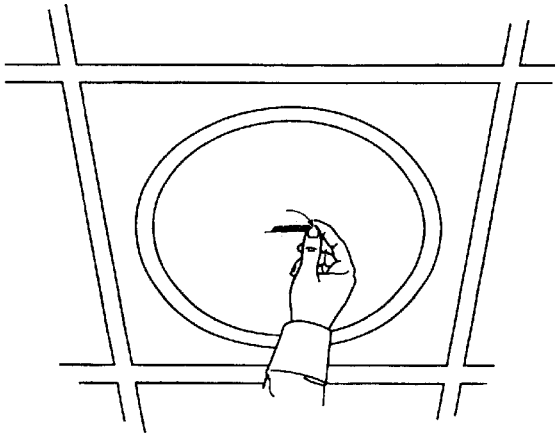
Figure 3H:
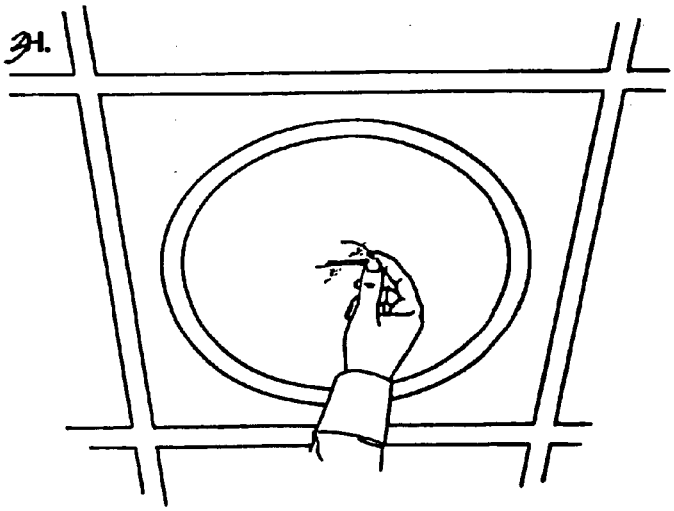

Referring to FIGS. 3A–3H, there are shown illustrations helpful in understanding an approach for mounting enclosure 10 in the ceiling. FIG. 3A shows enclosure 10 with the four fins 10A, 10B, 10C and 10D extended. FIG. 3B shows how a template 14 may be removed from a carton containing enclosure 10 and used in FIG. 3D with a pencil to mark the outline for cutting an opening in panel 11 with saw 15. FIG. 3E shows mounting enclosure 10 in the opening in a panel to be placed over panel 11 with fins 10A, 10B and 10C extended and resting a panel 12 for bridging ceiling tile 11. FIG. 3G shows installation of the grill cover over the loudspeaker enclosure, and FIG. 3H shows aligning the central logo to be parallel to one pair of opposed edges of ceiling tile 11 and perpendicular to the other.

Figure 4:
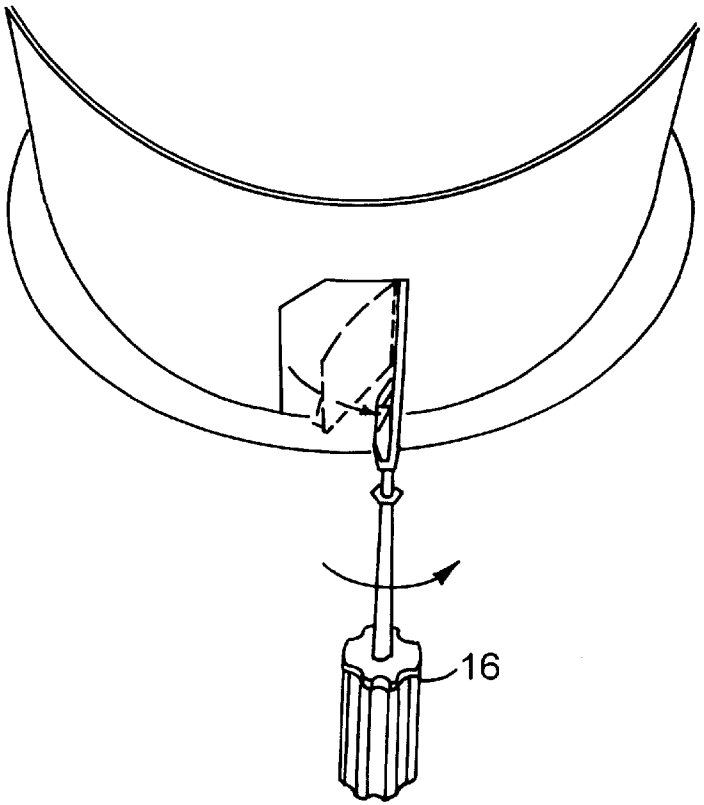
FIG. 4 illustrates a tool being used for retracting and extending fins.

Referring to FIG. 4, there is an illustration of how a tool 16 attached to the axle of a fin, such as 10A, may be used to retract and extend the fins. Initially the fins may be fully retracted to allow loudspeaker enclosure 10 to pass through the circular opening in the ceiling tile 11 and then extended with tool 16 so that the fins rest on ceiling tile 11 or bridging panel 12 and keep enclosure 10 in position.

Figure 5:
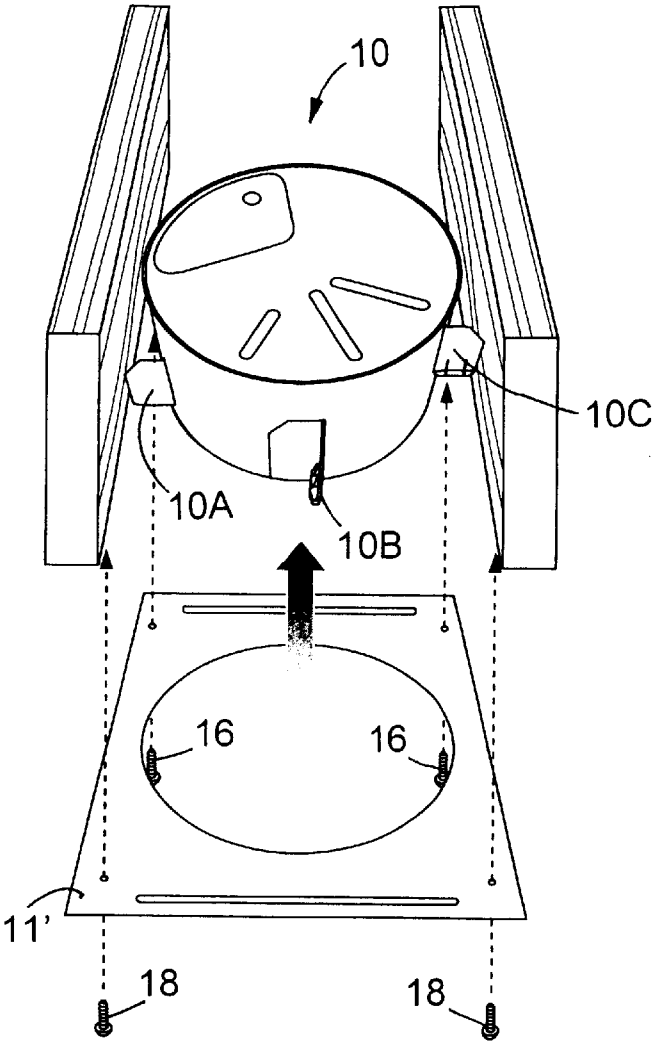
FIG. 5 is an exploded view showing an alternate way of ceiling mounting with screws.

Referring to FIG. 5, there is shown an exploded pictorial view showing an alternate way of securing enclosure 10 with screws, such as 16, engaging fins, such as 10A and 10C and ceiling tile 11' secured to cross members 17 with screws, such as 18.

There has been described novel apparatus and techniques for a ceiling enclosure having fins for use in securing the enclosure to a ceiling tile while allowing retraction of the fins into mating recesses to present a cosmetically pleasing surface when the enclosure is flown or hung from a suspension assembly. It is evident that those skilled in the art may now make numerous uses and modifications of and departures from the specific apparatus and techniques herein disclosed without departing from the inventive concept. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker enclosure suitable for mounting in a surface and flown from suspending cables comprising, a cylindrical loudspeaker enclosure having a plurality of fins that may be seated in mating recesses to then comprise a cosmetically pleasing outside wall, said fins being selectively movable between an extended position when above a ceiling surface and a retracted position seated in a mating recess when suspended by a suspension assembly.

2. A loudspeaker enclosure in accordance with claim 1 wherein said enclosure is of circular cross section.

3. A loudspeaker enclosure in accordance with claim 1 and further comprising said ceiling surface formed with an opening corresponding substantially to the cross section of said enclosure with said fins retracted, said fins being extended and resting above said ceiling surface.

4. A loudspeaker enclosure in accordance with claim 1 and further comprising said suspension assembly, said fins being retracted in a respective mating recess.

5. Apparatus in accordance with claim 3 and further comprising fasteners securing said enclosure to said ceiling surface.

* * * * *